United States Patent [19]

Campman

[11] Patent Number: 4,621,258

[45] Date of Patent: Nov. 4, 1986

[54] PROXIMITY DETECTING APPARATUS

[76] Inventor: James P. Campman, P.O. Box 167, Transfer, Pa. 16154

[21] Appl. No.: 524,940

[22] Filed: Aug. 22, 1983

[51] Int. Cl.[4] ..... G08B 13/26

[52] U.S. Cl. ..... 340/567; 340/562; 340/552

[58] Field of Search ..... 340/562, 567, 561, 552, 340/553; 307/116; 361/179

[56] References Cited

U.S. PATENT DOCUMENTS 4,155,078 5/1979 Bowling et al. ..... 340/561
4,345,167 8/1982 Calvin ..... 340/567 X

FOREIGN PATENT DOCUMENTS 2069206A 8/1981 United Kingdom ..... 340/561

*Primary Examiner*—James L. Rowland
*Assistant Examiner*—Jeffery A. Hofsass
*Attorney, Agent, or Firm*—Nies, Webner, Kurz & Bergert

[57] ABSTRACT

Apparatus and method for detecting changes in capacitance of an antenna due to intrusion into the antenna field by a body of different dielectric constant, in the presence of induced AC voltages on the antenna from electromagnetic radiation. The apparatus includes four operational amplifiers connected in a circuit for processing the production of voltage pulses. The first amplifier operates to rectify the AC voltages from the antenna to a DC fluctuating voltage, which voltages are averaged to produce a constant voltage above ground potential so long as there is no intrusion of the field. During this period no signal voltage is transmitted to the second amplifier. Intrusion will result in a decreased voltage level which causes the second amplifier output to swing from quiescent level to a lower level whereupon a negative going square wave voltage pulse appears at the output of the second amplifier and, through a capacitor, is applied to the inverting input of the third amplifier having its noninverting input terminal grounded. Normally, the third amplifier has zero output voltage and a negative going square wave voltage pulse from the second amplifier will produce a positive going square wave voltage pulse from the third amplifier, which feeds through a combined diode and R/C circuit and accumulator which has its output connected to the non-inverting input terminal of the fourth amplifier whose output is a positive going square wave voltage pulse applied to a transistor for triggering an alarm after a predetermined number of pulses have been accumulated.

3 Claims, 3 Drawing Figures

PROXIMITY DETECTING APPARATUS

BACKGROUND OF INVENTION

Heretofore, proximity detecting apparatus have been composed of active elements that require a continuous supply of energy.

One such apparatus has a continuously operating oscillator connected to a sensing element. When the capacitance on the sensing element changed due to the presence of an intruder in the field of the sensing element, the capacitance reactance would disturb the tuning of the oscillator circuit and it would cease oscillating to produce an increased current flow in the oscillator to activate a relay in an alarm circuit.

Another apparatus has more than one oscillator, one tuned to operate at a constant frequency and another operable at a frequency determined by the charge and voltage on the sensing element. When there is a change in the charge and thus the voltage at the sensing element a beat frequency would be produced which would be detected to cause an alarm to be activated.

Still another type of apparatus utilizes a metal oxide silicon field effect transistor instead of a vacuum-tube oscillator and the usual gas-type relay tube has been replaced with an npn bipolar transistor. When energized the oscillator will oscillate if there is no intrusion of the sensing element field. When intrusion occurs the oscillation ceases and there will be an increase in current in the transistor. This energizes the npn that is in the circuit of a relay that controls the alarm circuit.

There are several drawbacks to such apparatus. The first is that they all use oscillators which must be kept oscillating during the quiescent period between intrusions and this represents a constant expenditure of electrical energy. This in turn makes it necessary to utilize the power lines as a source of energy with the attending drawbacks of power lines for power failure, providing easy access to circuits that might be cut and the attending transient peak voltages that often trigger false alarms.

With the advent of the microelectronics and integrated circuit chips it is now possible to procure the extreme sensitivity, lower power drain and greater reliability. It is possible to provide circuits that have practically zero current drain during the quiescent periods thus making it possible to utilize batteries as a source of power and which now can serve for long periods of time without replacement. It is now possible to produce detecting apparatus smaller in size, with a minimum of complexity, less costly to produce and operate and easy to use. With these possibilities in mind it is the intent to provide a much improved proximity detector apparatus that may be used with simple and complex security systems.

OBJECTS OF THE INVENTION

It is an object of the invention to provide an extremely sensitive and reliable detecting apparatus.

Another object of the invention is to provide a proximity detecting apparatus that is capable of operating with a minimum power drain and which can be powered with a battery.

Another object of the invention is to provide a proximity detector that is affordable to the small operator, home owners and small offices establishments.

Yet another object of the invention is to provide a detecting apparatus that is more selective in its response whereby greater reliability may be achieved.

Other objects of the invention will become obvious as the disclosure proceeds.

DESCRIPTION OF THE APPARATUS

The apparatus includes a sensing element such as an antenna and the detecting apparatus, each subjected to separate treatment necessary for the results that are to be produced. For the purpose of disclosure of the invention and particularly the antenna and detecting apparatus as a means for contributing to those results, they are disclosed together. The antenna in the present disclosure is one that is suitable to be placed under a rug or carpet along a path that would have to be followed by an intruder. It is also designed to frame a window and door and other means of access to the secure area. By using an antenna with a very restricted field its ability to pick up radiation will be restricted, and the noise voltages therein reduced. By placing the antenna along the path the intruder would have to follow it is assured that there will be an intrusion of the field of the antenna. Other types of antenna may be used and the disclosure of this particular one is not intended to be limiting the use of the invention thereto.

An antenna cannot, unless shielded, be completely isolated from the radiation surrounding it and there will be alternating current voltages induced in the antenna though greatly reduced. By use of restricted lengths the antenna is made more responsive to higher frequencies which are of less intensity. However, the dominant radiation to which the antenna is subjected, is the sixty cycle radiation from electrical wiring of the building and power lines in the vicinity. In the present invention the voltage so induced in the antenna from the sixty cycle radiation is put to use in the establishment of a constant voltage whose level will be altered when an intruder enters the field of the antenna. The apparatus responds only to negative going changes in the level of the constant voltage which is produced by an increase in capacitance of the antenna when the intruder enters the field of the antenna. As the capacitance is increased by the intruder entering the field of the antenna, the voltage at the output of the antenna will decrease as will be seen from the equation $$E=Q/C$$

where E is the voltage in volts, Q is the charge on the antenna in columbs and C is the capacitance in farads.

Figure 3:
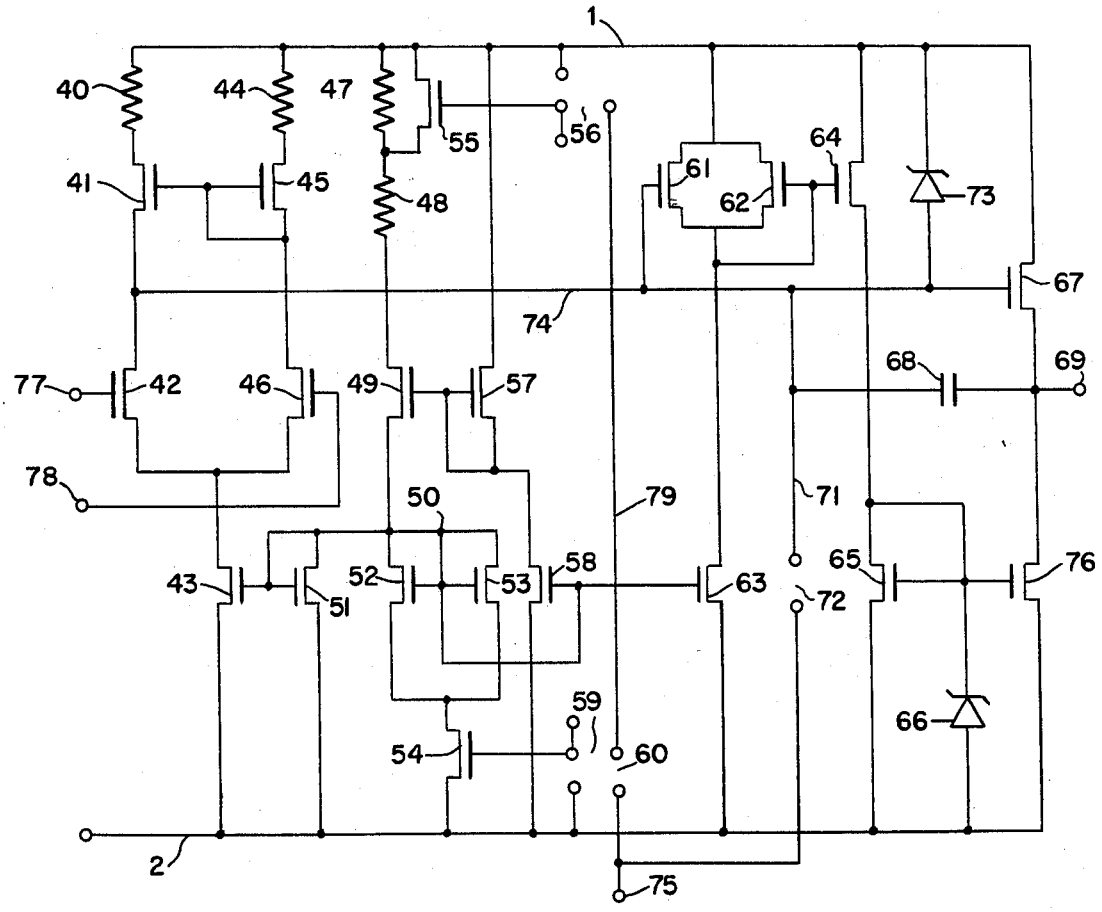
FIG. 3 is a schematic drawing of the individual operational amplifiers encompassed within the integrated chip disclosing the essentials of the understanding of the invention.

The antenna is shown as a conductor 8 which with conductor 9 serving as a ground is a twin conductor cable adapted to be laid under a rug and on the framing of a door or window. The antenna conductor 8 is connected through the input resistor 3 to the non-inverting input terminal of the first amplifier of the detecting apparatus. The amplifier is what is known as an operational amplifier of the type disclosed in FIG. 3 of the drawing. The non-inverting input terminal in FIG. 3 is terminal 78 connected to the transistor 46 of the operational amplifier. The ground conductor 9 is connected to the ground buss 2. The inverting input terminal of the amplifier is connected between the resistors 6 and 7 of a voltage divider that is connected between the voltage buss 1 and the ground buss 2 shown in FIG. 1. Amplifier 11 has a feedback circuit comprising a resistor 4 and variable capacitor 5 in parallel connected from the output terminal of amplifier 11 and the non-inverting input terminal of the amplifier 11.

The ratio of the resistance of the resistor 4 to the resistance of resistor 3 determines the amplification factor of the amplifier 11. The variable capacitor, being adjustable can adjust for differences in distributed capacitances between the conductor 8 and 9 and is for nulling out the capacitance.

The sixty cycle radiation, if present on the antenna, will provide a sixty cycle alternating voltage on the antenna about the potential of ground. When applied to the non-inverting input terminal of amplifier 11, with the inverting input terminal biased at a voltage of V/2 from the voltage divider, there will be a sixty cycle direct current fluctuating voltage at the output of amplifier 11. The fluctuation will be about the V/2 voltage level. This output is transmitted through a diode 10 connected to the output and a filter circuit.

The filter circuit comprises a capacitor 12 in parallel with a resistor 13 connected to the ground buss 2. The output of the filter is through a capacitor 14. The alternating voltages from amplifier 11 are ironed out in the filter circuit to produce a constant voltage which will be at a level of V/2. This is applied to the capacitor but it will not be transmitted. The capacitor transmits only changes in voltage. Thus it will seen that until and only if there is a change in the level of the contant voltage in the filter circuit there will be no signal voltage transmitted beyond the capacitor 14. The constant voltage state of the filter circuit is during the quiescent periods between the intrusions of the antenna field.

When there is an intrusion of the antenna field there is an increase in capacitance on the antenna. The increase in capacitance results in a negative going square wave voltage pulse being produced on the capacitor 14. This square wave voltage pulse produces two spike voltage changes at the output of capacitor 14. The leading one having a negative going step voltage change followed by an exponential positive going decaying voltage as the charge on capacitor 14 changes, and a positive going spike voltage change having a positive going step voltage change followed by an exponential decaying voltage change at the conclusion of the negative going square wave voltage pulse.

The output of the capacitor 14 is connected to the non-inverting input terminal of the second amplifier 15. The inverting input terminal of amplifier 15 is connected to the voltage divider between resistors 6 and 7, whereby it is biased at a voltage of V/2. The output of amplifier 15 is connected through a feedback resistor 16 to the non-inverting input terminal of amplifier 15.

As previously stated, the non-inverting input of amplifier 15 is normally substantially constant. When a negative going square wave voltage pulse with the negative going spike voltage change occurs, there is enough input to cause the output voltage to swing towards the negative value, where it remains until the positive going spike voltage change occurs at the end of the square wave voltage pulse, which causes the output to swing back to the initial level of V/2, where it remains until another square wave voltage pulse occurs.

Thus, there is produced at the output terminal of the amplifier 15 a negative going square wave voltage pulse from a negative going square wave voltage pulse at its input.

If a positive going square wave voltage pulse is produced in the filter circuit, as may well happen, there would be at the non-inverting input terminal of amplifier 15 a positive going spike voltage change followed by a negative going spike voltage change. This would cause the output of amplifier 15 to swing between the V/2 voltage level and the V voltage level and back to the V/2 voltage level to produce a positive going square wave voltage pulse at the output of amplifier 15. It should be noted that the voltage swings at the output of amplifier 15 are of equal amplitude and the amplitudes are constant and amplified over the input voltage changes.

The output of the amplifier 15 is connected through capacitor 17 to the inverting input terminal of the third amplifier 19. The inverting input terminal is also biased from the voltage buss 1 through resistor 18 and the non-inverting input terminal of the amplifier 19 is connected directly to the ground buss 2. Amplifier 19 is also an operational amplifier of the structure shown in FIG. 3 to be described later. The non-inverting input terminal is connected to the gate of transistor 46 of the amplifier 19. Thus transistor 46 is the same as an open circuit. During the quiescent period the inverting input terminal has a V/2 voltage applied thereto causing a voltage drop across the capacitor 17. This produces a V/2 voltage on the gate of transistor 42 (FIG. 3) causing it to have a current therein. The current flowing through transistor 42 produces a voltage drop across the resistor 40 and transistor 41 which is connected to the output terminal of amplifier 19, making it at a low voltage.

Now when there is a negative going square wave voltage pulse transmitted to capacitor 17, this produces a negative step voltage change on the capacitor 17 followed by a positive going step voltage change at the conclusion of the square wave voltage pulse. A negative going step voltage change on the capacitor results in a greater voltage drop across capacitor 17 and the voltage on the inverting input terminal will be decreased to zero. This produces a decrease in current in transistor 42 of amplifier 19 and through resistor 40 and transistor 41 and thus an increase in the voltage at the output of amplifier 19. When the following positive going step voltage change is transmitted to the inverting input terminal the voltage at the output of amplifier 19 will increase to V/2 and the current in transistor 42, transistor 41 and resistor 40 will increase to produce a decrease in voltage at the output of amplifier 19. Thus there is the production of a positive going square wave voltage pulse from the amplifier 19 when there is a negative going square wave voltage pulse at its input terminal.

Instead of a negative going square wave voltage pulse, let it be a positive going square wave voltage pulse produced at the output of amplifier 15. Again we start with a V/2 voltage level at the output of amplifier 19.

Now if there is a positive going square wave voltage pulse, the positive going step voltage change would cause a decrease in the voltage across capacitor 17. This would result in an increase in voltage on the inverting input terminal of amplifier 19 and an increase in current in transistor 42. This in turn produces a decrease in voltage at the output of amplifier 19. But, this cannot happen because of the output from amplifier 19 is already at the zero level. Thus, the amplifier 19 does not respond to positive going square wave voltage pulses. This accounts for the selectivity of response of the apparatus for negative going square wave voltage pulses, which enhances the reliability of the apparatus.

The output of amplifier 19 is connected through a resistor 20, shunted by a switch 21 and through a diode 22 to a parallel circuit having resistor 23 and capacitor 24 connected to the ground buss 2. The circuit is connected from a point between the diode 22 and the parallel circuit to the non-inverting input terminal of the fourth amplifier 25. The inverting input terminal of amplifier 25 is connected to a voltage divider between resistors 26 and 27 which is connected between the voltage buss and the ground buss 2. The output of amplifier 25 is connected to the base of transistor 29 through resistor 28, which is in a circuit with a relay coil of relay 30, connected between the voltage buss and the ground buss 2.

The coupling between the third and fourth amplifier 25 operates to select between one pulse response and a predetermined number of pulses. When the switch 21 is closed the fourth amplifier responds to single pulses from the third amplifier 19. When the switch is open, the fourth amplifier responds to a predetermined number of voltage pulses after the predetermined number of pulses raises the voltage on capacitor 24 so the the fourth amplifier is triggered. The output from amplifier 25 is coupled through resistor 28 which limits the current in the base emitter circuit of transistor 29. When transistor 29 becomes conductive, the relay is activated to close the contacts which are in an alarm circuit and the alarm is activated.

Figure 2:
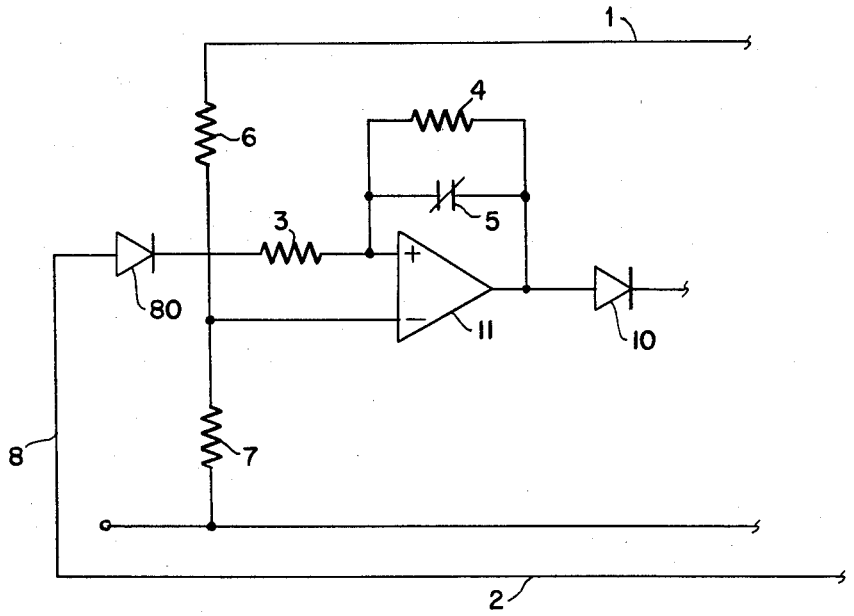
FIG. 2 is a schematic drawing of the front end of a modified version of the detecting apparatus.

FIG. 2 shows the same type of detector apparatus which is adapted for use of a single conductor antenna. An earth ground connection such as to water pipe, a ground rod driven in the ground is to be connected to the ground buss 2. The single wire antenna is connected through a diode 80 and resistor 3 to the non-inverting input terminal of the first amplifier. Otherewise the second version of the invention is the same as the first. The purpose of the diode 80 is to produce rectification of the input from the antenna to the non-inverting input terminal.

Figure 1:
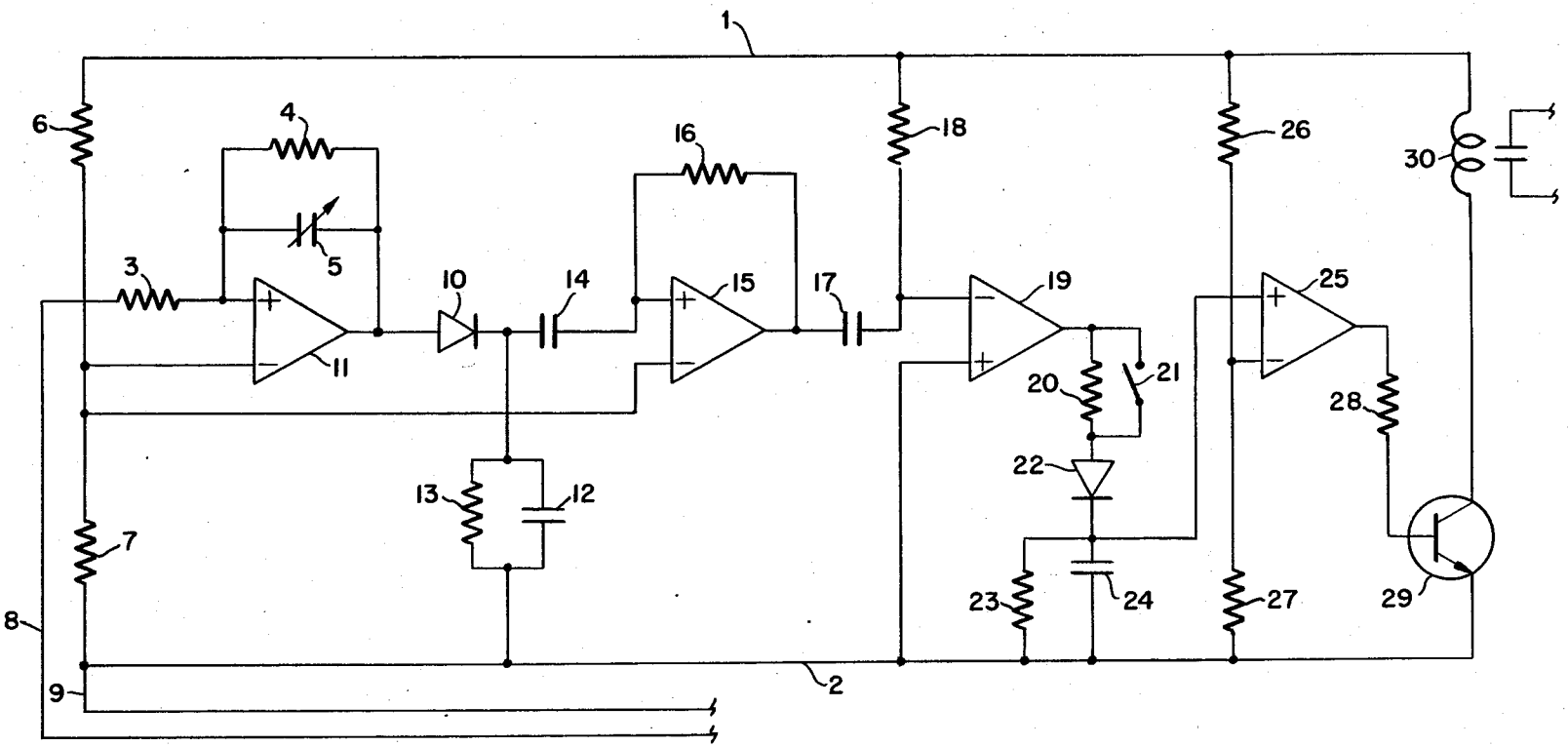
FIG. 1 is a schematic drawing of the entire detecting apparatus.

FIG. 3 discloses the structure of the amplifiers in the chip which are four in number. They are operational amplifiers using metal oxide silicon field effect transistor structure, wherein the input is to gates made of a thin layer metal forming a capacitor input. The only difference between the amplifiers in the circuit of FIG. 1 is in the nature of the external connections and components that are connected to the amplifiers.

As shown in FIG. 3. the amplifier is composed of three sections, namely the input section, the setting section and the output section. The input section is composed of a first and second circuit connected in parallel and in series with a constant current transistor 43.

The first circuit comprises a resistor 40, transistor 41 which serves as a resistor and transistor 42. The gate of transistor 42 is connected to the inverting input terminal 77, made so by the connection 74 between the input and output sections connected between the transistors 41 and 42.

The second parallel circuit of the input stage or section is composed of resistor 45 and transistors 45 and 46. Transistor 45 also serves as a resistor. The gates of transistors 41 and 45 are connected together and to the second parallel circuit between the transistors 45 and 46. The gate of transistor 46 is connected to the non-inverting input terminal 78. The conductivity of transistors 41 and 45 is decreased and increased as the current through transistor 46 is increased and decreased. The gate of transistor 43 is connected to the constant voltage buss 50 and the voltage is determined by the setting section.

The setting section consists of two parallel circuits, one comprising of resistors 47, 48, transistor 49 connected to the constant voltage buss 50. The resistor 47 is shunted by the source-drain channel of transistor 55, which has its gate connected to the movable contactor of a three position switch 56. One position is connected to the voltage buss 1, another is connected to the conductor 70 leading to an exterior terminal 75 and the third of which is unconnected.

The constant voltage buss 50 is connected to the gates of transistors 43,51, 52, 58, and 63, and to the source-drain channels of the transistors 51, 56, and 53. Transistors 52 and 53 have their drains connected together and through the source-drain channel of transistor 54 to the ground buss 2. The gate of transistor 54 is connected to the movable contactor of a three position switch 59. One position is connected to the ground buss 2, another is connected to the circuit 79 and the third is unconnected. The circuit 79 has a connection 60 which will join the circuit 79 to the exterior terminal 75.

The second of the parallel circuits of the setting section comprises a transistor 57 in series with transistor 58 between the voltage and ground buss 2. The gates of transistors 49 and 57 are connected together and to the second parallel circuit of the setting section at a point between the transistors 57 and 58. The second of the parallel circuits of the setting section serves as a voltage divider to control the bias on the gates of transistors 49 and 57.

The output section is comprises of three parallel circuits connected between the voltage and ground busses 1 and 2. The first of said three circuits comprise of transistors 61 and 62 in series with transistor 63. Transistors 61 and 62 are in parallel with each other. The gate of transistor 61 is connected to the conductor 74 that connects the input and out put sections together. The first parallel circuit serves only to provide the bias on the gates of transistors 62 and 64. The second parallel circuit of the output section is comprised of transistors 64 and 65 in series between the voltage and ground busses 1 and 2. The gates of transistors 65 and 76 are connected together and to the second parallel circuit of the output section. The second section serves only to determined the bias on the transistors 65 and 76. The third parallel circuit of the output section comprise of the transistors 67 and 76 in series between the voltage and ground busses 1 and 2. The gate of transistor 67 is connected to the conductor 74. The conductor 74 is also connected to the third parallel circit between the transistors 67 and 76 through a capacitor 68 and a portion of conductor 71. The output terminal 69 is connected to the same point on the third parallel circuit.

A zener diode 66 is connected between the ground buss and the gates of the transistors 65 and 76. A zener diode 73 is connected between the conductor 74 and the voltage buss 1. The output of the amplifier is determined by the voltage applied to the gate of transistor 67. The conductivity of the transistor 76 is held constant. The conductor 71 is connectable through the contacts 72 to the external terminal 75.

Amplifiers 11, 15 and 25 have their non-inverting inputs connected to the terminal 78. Amplifier 19 has its input connected to terminal 77. Amplifiers 11 and 15 have their terminal 77 connected to the voltage divider. Amplifier 25 has its inverting input terminal connected to the second voltage divider between resistors 26 and 27. Amplifier 19 has its inverting input terminal connected to terminal 77 and its non-inverting input terminal connected directly to the ground buss 2.

The mode of operation has already been made clear through the disclosure of the various sections of the apparatus.

The most distinguishing features about the present invention is that the voltages derived from the radiation is utilized to provide a constant voltage at one level which is decreased in level when there is an intrusion of the field of the antenna. The apparatus selectively is responsive to negative going square wave voltage pulses and not to positive going voltage pulses, thus eliminates many of the causes of false alarms. The apparatus is extremely sensitive by utilizing all the capabilities of the amplifiers. Its current drain during quiescent period is so low that a battery can be used to power the apparatus, thus eliminating the need for use of power lines with all their attending drawbacks.

| List of components and values | | | |
|---|---|---|---|
| Resistors | | Capacitors | |
| 3 | 10 m | 5 | variable |
| 4 | 100 m | 12 | 1 mf |
| 6 | 10 m | 14 | .1 mf |
| 7 | 10 m | 17 | .1 mf |
| 13 | 1 m | 24 | .1 mf |
| 16 | 100 m | | |
| 28 | 10 k | | |
| 20 | 560K | | |

It will be apparent that various changes and modifications can be made in the details of the structure and use without departure from the spirit of the invention especially as defined in the following claims.

I claim:

1. Apparatus for detecting an intrusion of an ambient electromagnetic field of an antenna, in the presence of radiation about said antenna that produce voltages on the antenna for providing an indication of the intrusion of said electromagnetic field;

an antenna capable of receiving said electromagnetic radiation and having a voltage generated therein by said radiation and wherein there is a change in level of voltage so generated which will be above or below the level where there is no intrusion, a first amplifier for receiving said alternating current voltages at said levels and for producing a direct current voltage fluctuation at the same frequency as said alternating current voltage, but at a level elevated from that of the alternating current voltage;

filtering means for receiving said direct current fluctuations and for producing a constant direct current voltage at a level responsive to each change in level of the fluctuating direct current voltage;

a second amplifier receiving changes in level of said constant voltage to produce a negative or positive going square wave voltage pulse, constant in amplitude;

a third amplifier responsive only to the negative going square wave voltage pulses to produce a positive going square wave voltage pulse;

a fourth amplifier for receiving the output from said third amplifier having means there between whereby response of said fourth amplifier can be selectively made responsive to a single square wave voltage pulse or to a square wave voltage pulse produced after the occurrence of a plurality of square wave voltage pulses; and means receiving the output of said fourth amplifier for triggering an indication of said intrusion.

2. Apparatus according to claim 1, wherein the antenna is a pair of uniformly spaced conductors separated one from the other by a dielectric material that also encompasses both said conductors, one of said conductors serving as the antenna connected to the input terminal of said first amplifier and the other of said conductors connected to ground.

3. Apparatus according to claim 1, wherein the means coupling said fourth and third amplifiers comprise, means connected to the output of said third amplifier for measuring out the number of pulses required to cause a response of said fourth amplifier, and means for shunting said measuring means to cause a response of said fourth amplifier to each and every single square wave voltage pulse.

* * * * *